US006042109A

United States Patent [19]

Klausbruckner

[11] Patent Number: 6,042,109

[45] Date of Patent: Mar. 28, 2000

[54] SHEET FEEDING DEVICE WITH COMPACT MEDIA PATH FOR PAPER-BASED AND PHOTOGRAPHIC MEDIA

[75] Inventor: Michael J. Klausbruckner, San Diego, Calif.

[73] Assignee: Hewlett-Packard Company, Palo Alto, Calif.

[21] Appl. No.: 08/919,563

[22] Filed: Aug. 29, 1997

[51] Int. Cl.[7] ..... B65H 5/00

[52] U.S. Cl. ..... 271/225; 271/184; 271/185; 271/186; 271/902

[58] Field of Search ..... 271/225, 184–186, 271/902

[56] References Cited

U.S. PATENT DOCUMENTS

| | | | |
|---|---|---|---|
| 4,066,252 | 1/1978 | Wick | 271/902 X |
| 4,873,548 | 10/1989 | Kobayashi et al. | 355/200 |
| 5,197,724 | 3/1993 | Kitajima et al. | 271/186 X |
| 5,210,616 | 5/1993 | Kawasaki et al. | 271/225 X |
| 5,280,331 | 1/1994 | Namiki | 355/318 |
| 5,303,017 | 4/1994 | Smith | 271/186 X |
| 5,762,431 | 6/1998 | Pawelka et al. | 271/902 X |

FOREIGN PATENT DOCUMENTS

| | | | |
|---|---|---|---|
| 0274989 | 12/1987 | European Pat. Off. . | |
| 3615958 | 11/1986 | Germany | 271/186 |
| 3632517 | 3/1988 | Germany | 271/186 X |
| 215646 | 8/1990 | Japan | 271/184 |
| 256643 | 9/1992 | Japan | 271/225 |
| 272057 | 9/1992 | Japan | 271/184 |
| 308147 | 10/1992 | Japan | 271/186 |
| 323161 | 11/1992 | Japan | 271/186 |

OTHER PUBLICATIONS

European Search Report regarding European Patent Application 98103376.4–2304–.

Patent Abstracts of Japan, vol. 018, No. 611 (M–1708), Nov. 21, 1994 & JP 06 234255A (Tokyo Electric Co. Ltd), Aug. 23, 1994.

*Primary Examiner*—Christopher P. Ellis
*Assistant Examiner*—Richard Ridley

[57] ABSTRACT

A sheet feeding device for a photographic image forming device which has a print part, such as an inkjet. A non-stationary sheet pick device pushes the separated sheet out of the paper tray in an upward angle. Then the separated sheet is pushed towards a sheet feeding roller which in turn forces the sheet through a radius, so that the trailing edge never touches the roller. Then the roller reverses the rotation direction and pushes the sheet backwards. A sheet path control device forces the sheet into a new paper path direction, onto the print table and towards the final sheet advance roller. Forcing the sheet through a radius and providing a paper path which wraps around the print mechanism enables miniaturization of the entire device.

20 Claims, 11 Drawing Sheets

200
230
228
226
220
224
218
216
222
212
214
210
232
206
204
234
208
52
238
236
206

SHEET FEEDING DEVICE WITH COMPACT MEDIA PATH FOR PAPER-BASED AND PHOTOGRAPHIC MEDIA

TECHNICAL FIELD OF THE INVENTION

This invention relates to sheet feeding devices, and more particularly to a sheet feeding device having a compact path for feeding sheet media such as paper and photographic media.

BACKGROUND OF THE INVENTION

New types of imaging-printers will depend on the extensive use of special, photographic media. Such media typically includes a carrier medium (plastic or paper-based) which is coated on one or two sides with one or more layers of special material. The resulting blank (ink receptacle) medium provides excellent image quality, but is very susceptible to media damage such as scratches, chemical surface change through contact with other materials such as surfactants, and the like. Moreover, the special photographic media usually curl extensively due to their layered/sandwich-type construction, and are fairly stiff as compared to plain paper, and therefore difficult to bend. This invention addresses several problems associated with handling such special media.

One problem is that of minimizing the necessary operating space for paper-handling and minimizing sheet deformation/sheet curl. A straight paper path requires a large printer-footprint, especially in operational conditions, in which the printer requires a pull-out tray. A large foot print is especially undesirable in a home environment. The occupied space can be reduced, if a curved paper path is applied. However, conventional curved paper paths bend the paper (sheets) through a small bending radius, which results in sheet-curl. A curved paper path in accordance with one aspect of this invention utilizes a relatively large bending radius, minimizing sheet curl, while minimizing the space required to operate the sheet-feeding device, since the sheet is wrapped around the print mechanism in order to minimize space utilization.

Another problem is a tendency of special media to jam in the paper path, and skewing of the media position while passing through the paper path. Some known curved paper paths are based on a long travel distance of the media sheets and therefore many parts inside of the paper path have to be optimized to avoid paper jams and to produce low failure rates. As a result, these paper paths are expensive to design and to manufacture, and need high maintenance as well. The paper travel distance in the paper path in accordance with an aspect of this invention is relatively short as compared with some laser printers and copy machines, which reduces the need for extensive optimization. Further, after the sheet is picked through the pick device in accordance with this aspect of the invention, it is pulled and pushed by only one roller before it is fed through the final sheet-advance roller. Sheet skew, a rotation around the sheet surface normal axis, is minimized, because the sheet never leaves the roller before it is finally fed into the sheet-advance roller.

One common type of pick system is a stationary roller pick system, where the pick roller is fixed with respect to the media path; i.e. a stationary roller system would allow only one radius of curvature for the media while picked. A stationary roller pick system is less suited for picking different media sets, such as an application which is called upon to handle standard paper as well as special photographic media. The stationary pick system is not flexible enough to adjust "itself" for the elastic properties of different media. Therefore high pick failure rates frequently occur. In addition, a stationary roller system requires more space than a "dynamic" pick system in a curved paper path in accordance with a further aspect of this invention, which pushes the sheets in an angle out of the sheet tray. On the other hand, a "dynamic" pick system allows for different radii of curvature depending on the stiffness of the picked medium and therefore allow for improved pick reliability. A dynamic pick system is used in the auxiliary sheet feeding trays of the HP1600 DeskJet and the LaserJet 4MV products marketed by the assignee of this application. The utility of this invention is independent of the pick system used, as a sheet feeding device in accordance with this invention can be employed with dynamic pick systems as well as stationary pick systems.

Another problem addressed by the invention is that of minimizing surface degradation of photographic media. Conventional curved paper paths move the paper or any sheet-media with its sensitive surface on the inside bending radius, as well as the outside bending radius, which in turn will result in a high surface degradation. In addition, sometimes the sensitive surface of the media touches corners and edges while moving through the paper path. This will result in further degradation of the print surface, especially if the surface is coated with a scratch sensitive coating found in photographic media.

SUMMARY OF THE INVENTION

A sheet feeding system is described for feeding a sheet of print media from an input supply device to an ink jet printing device along a media path. The system includes a media path defined through the system and having a curved path portion and a media printing/output path portion. The sheet feeding system further includes a sheet path control device, and a pick apparatus for picking a sheet from the input supply device and passing the sheet into the entrance to the media path. A sheet drive system transports the picked sheet in a forward direction along the curved media path portion until a trailing edge of the picked sheet passes a predetermined location on the media path. The sheet drive apparatus is further adapted to transport the picked sheet in a reverse direction, such that the trailing edge in a forward direction sense is now the leading edge in a reverse direction sense. An actuating apparatus is adapted to move the sheet path control device for deflecting the picked sheet into the printing/output media path portion. The system includes apparatus for passing the picked sheet along the printing/output media path portion through a printing area to an output end of the printing/output media path portion.

In accordance with another aspect of the invention, a method is described for feeding a sheet of print media from an input supply device to an ink jet printing device along a media path. The method includes the following steps:

- picking a sheet from the input supply device and passing the sheet into the entrance to the media path;
- transporting the picked sheet in a forward direction along a curved media path portion until a trailing edge of the picked sheet passes a predetermined location on the media path;
- actuating a sheet path control device;
- transporting the picked sheet in a reverse direction, such that the trailing edge in a forward direction sense is now the leading edge in a reverse direction sense, and deflecting the picked sheet with the sheet path control device into a printing/output media path portion; and passing the picked sheet along the printing/output media path portion through a printing area to an output end of the printing/output media path portion.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 shows the pick roller in place and rotating to pick a sheet from the supply tray into engagement with a handling roller, to bring the sheet into an intermediate position.

FIG. 3 shows the sheet in its intermediate position, with the system deflecting vanes actuated for deflecting the sheet when brought down to a printing position.

FIG. 4 shows the handling roller's drive direction being reversed, bringing the sheet down from the intermediate position, with the vanes deflecting the now-leading edge of the sheet toward the printing position.

FIG. 5 shows the sheet in the printing position.

FIG. 6 is an isometric view of the handling rollers and plate assembly.

DETAILED DESCRIPTION OF THE PREFERRED EMBODIMENTS

Figure 1:
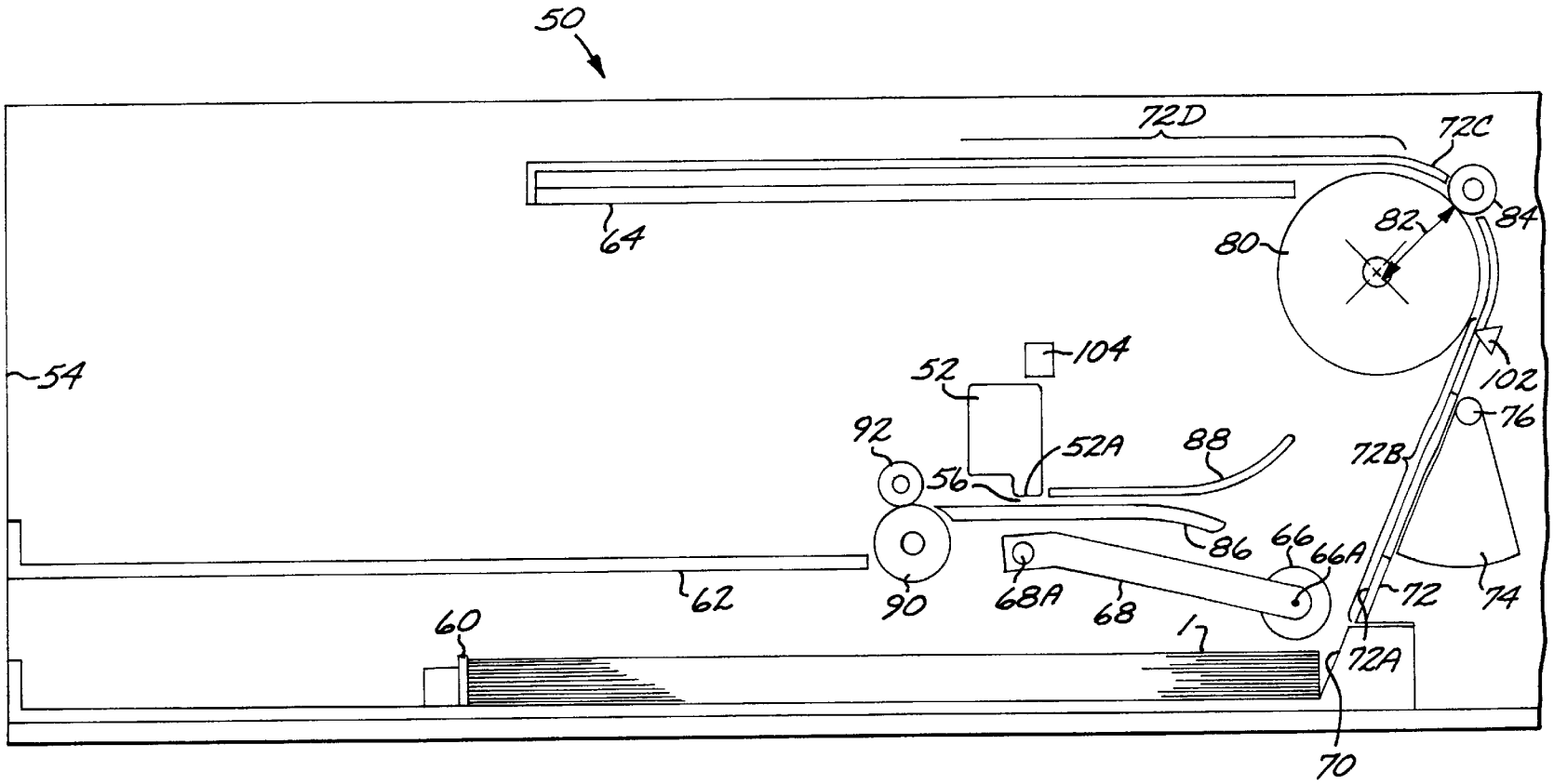
FIG. 1 is a side view of a compact printing system embodying a paper path in accordance with this invention.

A new paper path and method for feeding media through a printer/imager is described which minimizes space requirements and optimizes several critical paper-handling issues. The term "paper path" is used herein to describe the path of flexible sheets inside the printer; it is not limited to paper, and includes any flexible sheet-media including photographically coated media.

An exemplary embodiment of a media path system 50 embodying the present invention is illustrated in FIGS. 1–9. This system includes an inkjet printing module 52, which will typically include a plurality of inkjet cartridges with a plurality of inkjet printheads for printing color images. One such printhead is illustrated as element 52A. The cartridges are mounted on a scanning carriage which is driven along a scan axis transverse to the direction of paper advancement through the print area. The carriage has mounted thereon an optical sensor 104 for sensing the presence of a leading edge of a sheet as it is passed toward the print area.

The system 50 includes a housing structure 54, preferably formed by injection molding, which houses the sheet feeding device of this embodiment. A sheet input tray 60, which can also be used as a sheet output tray, is installed in an lowermost part of this device housing. A printed discharged sheet is accumulated on the discharging tray 62, which can alternatively be combined with the input tray 60. An uppermost sheet guide 64 is used as a temporary sheet storage device, as well as to increase the stiffness of the printer housing structure.

A separation roller 66 is selectively driven in a counterclockwise direction about pivot 66A, and is mounted at the end of arm 68, which in turn is pivotable about pivot 68A. A drive apparatus is provided to move the arm through a pivoting range of motion, under control of the system controller.

An incline surface 70 is provided adjacent an end of the input tray, and guides a sheet being picked from the tray onto sheet guide 72. A sheet path control device 74 is selectively pivoted about a pivot 76 by a drive apparatus, as will be described more fully below.

A mechanical flag sensor 102 is positioned in the paper feed path above the sheet path control device 74, and is tripped by the leading edge of the sheet 1. The sensor 102 also provides a signal when the trailing edge of the sheet passes the location of the flag sensor, permitting the spring-loaded flag to emerge again above the surface of the guide 72.

The sheet guide 72 has a first linear path portion 72B, a curved path portion 72C and a second linear path portion 72D. The radius of the curved path portion is slightly larger than the radius 82 of a sheet feeding roller 80. A pinch roller 84 is disposed intermediate the curved path portion. The rollers 80 and 84 include an outer material layer which contacts the print medium, and is preferably a high friction material. This layer can comprise a soft material such as polyurethane foam, isopren, EPDM or the like, although hard materials can also be used. The rollers will not scratch the surface of the media as long as there is no slippage between the rollers and the media.

The system further includes a print table 86 which supports the sheet at a print zone 56 adjacent the area subtended by the printhead 52A. A sheet guide 88 is disposed above the print table. A sheet advance roller 90 with a pinch roller 92 engages a leading edge of the media to pull the media through the print zone during print operations, and out onto the output tray 62.

Figure 3:
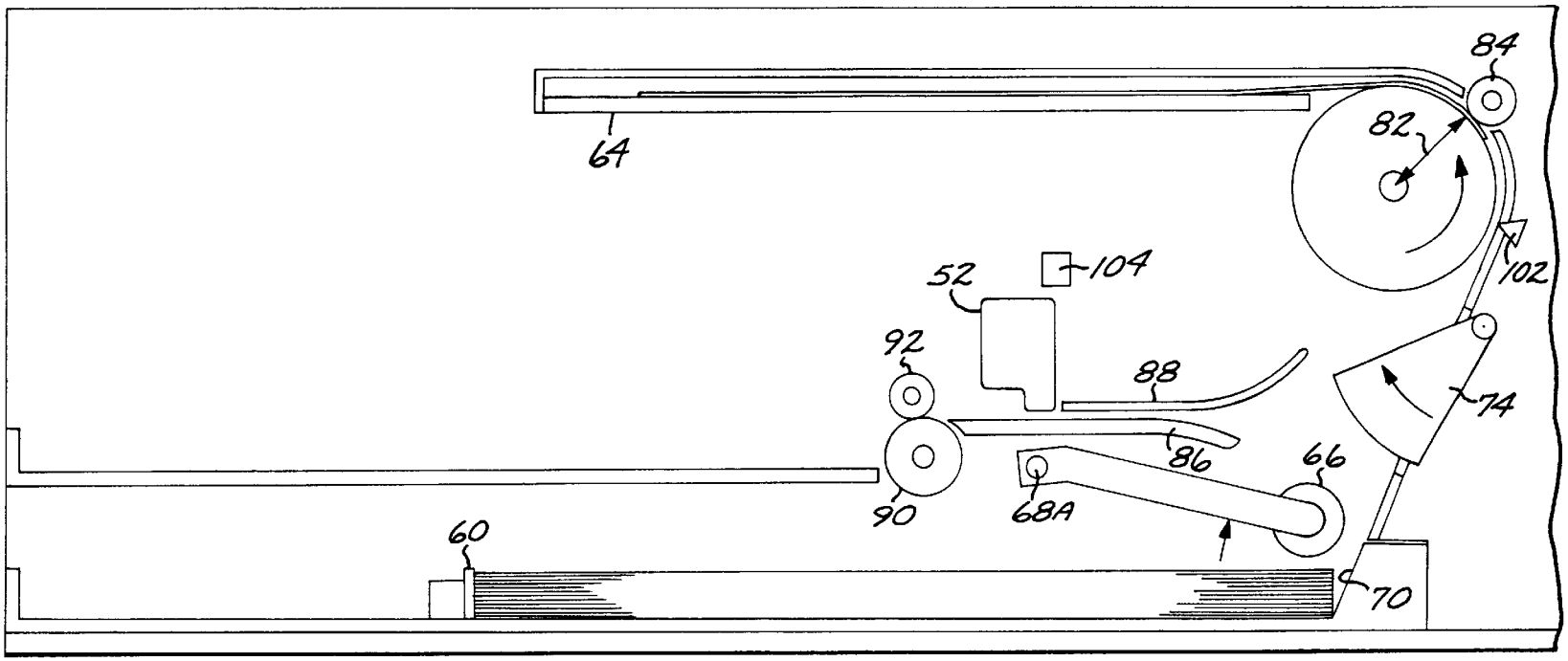
Figure 6:
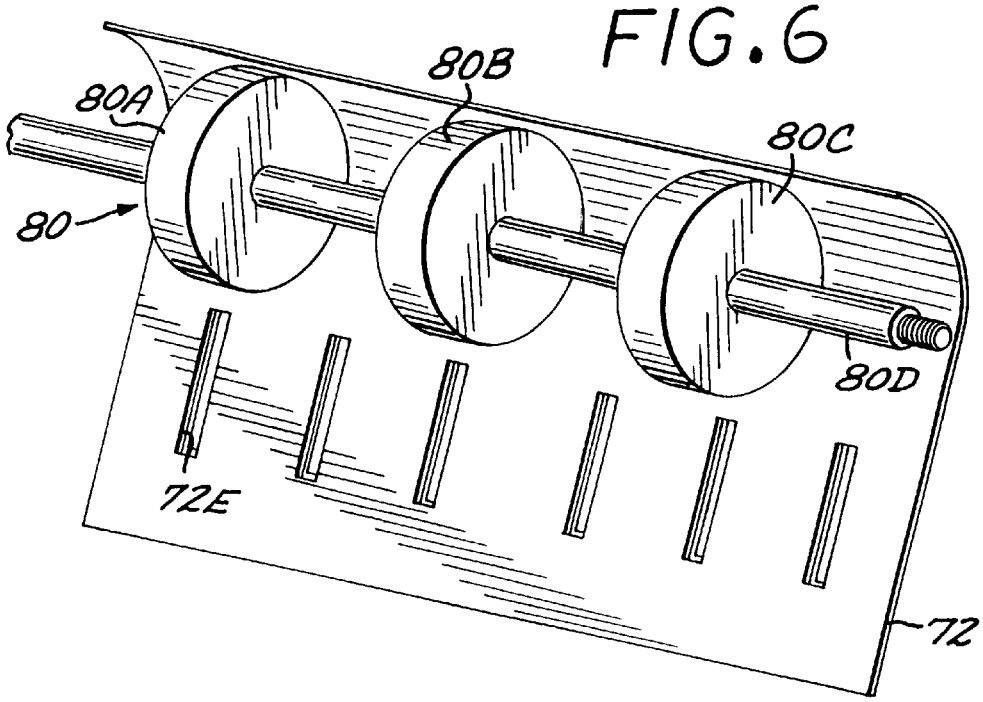
Figure 7:
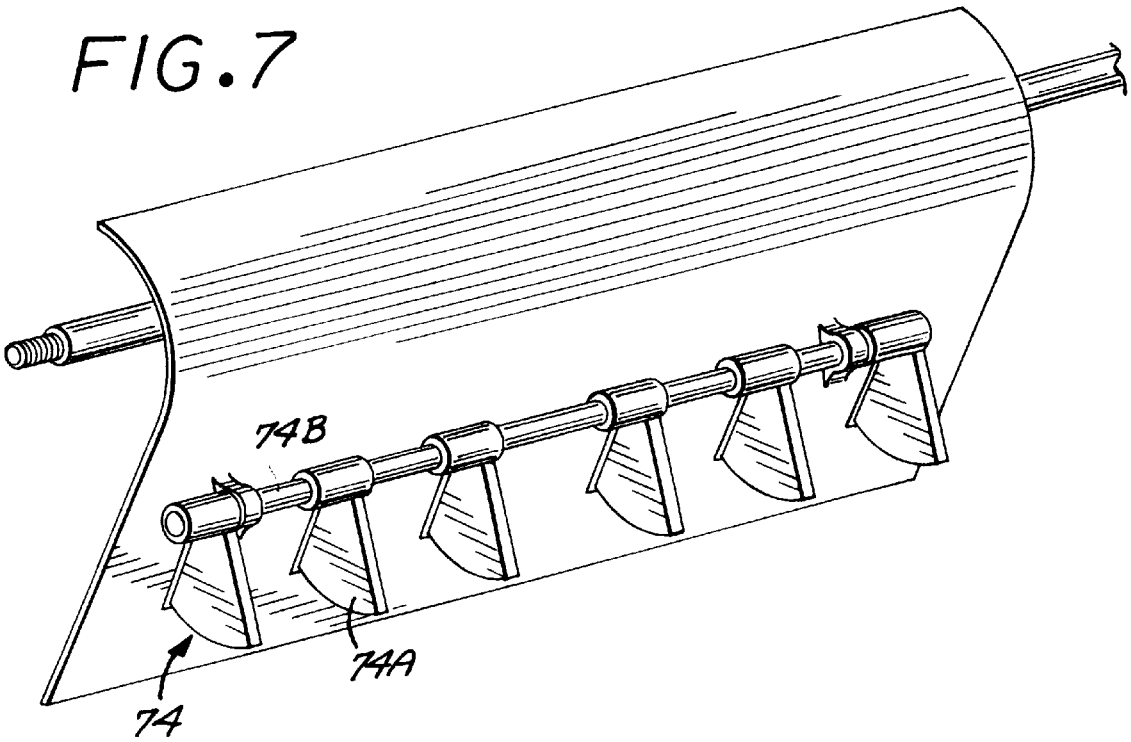
FIG. 7 is a reverse view of the structure of FIG. 7, showing the deflecting vanes.

FIG. 6 illustrates an exemplary form of the sheet feeding roller 80. In this embodiment, three relatively narrow rollers 80A–80C are employed, mounted on a shaft 80D and spaced across the width of the media path. A page-wide roller would touch the medium only at discrete points/areas, and rarely across its entire width, since the sheets are subject to curling and the sheet feeder components are subject to tolerance deviations. The use of several small width rollers as shown in FIG. 6 uniquely locates the areas of contact between the rollers and the medium, and is also more economical. A paper transport motor 110 (FIG. 8) drives the shaft and the rollers mounted thereon. Also visible in FIG. 6 are the elongated slots 72E formed in the guide 72 along the direction of paper movement. These slots enable the paper path control device 74 to move out from a standby position shown in FIG. 7 to a paper path redirection position (FIG. 3). The device 74 in this exemplary embodiment comprises a plurality of triangularly-shaped vanes 74A mounted on a shaft 74, with the vanes spaced on the shaft in alignment with corresponding slots formed in the guide 72. The shaft 74B is rotationally driven by an actuator motor 108 (FIG. 8), to move the device between the standby position and the redirection position. When in the standby position, the vanes are disposed below the surface 72A so as not to contact the media on its upward journey to the roller 80. With the device in its redirection position, the vanes 74A contact the media and redirect the leading edge toward the print tray 86.

Figure 8:
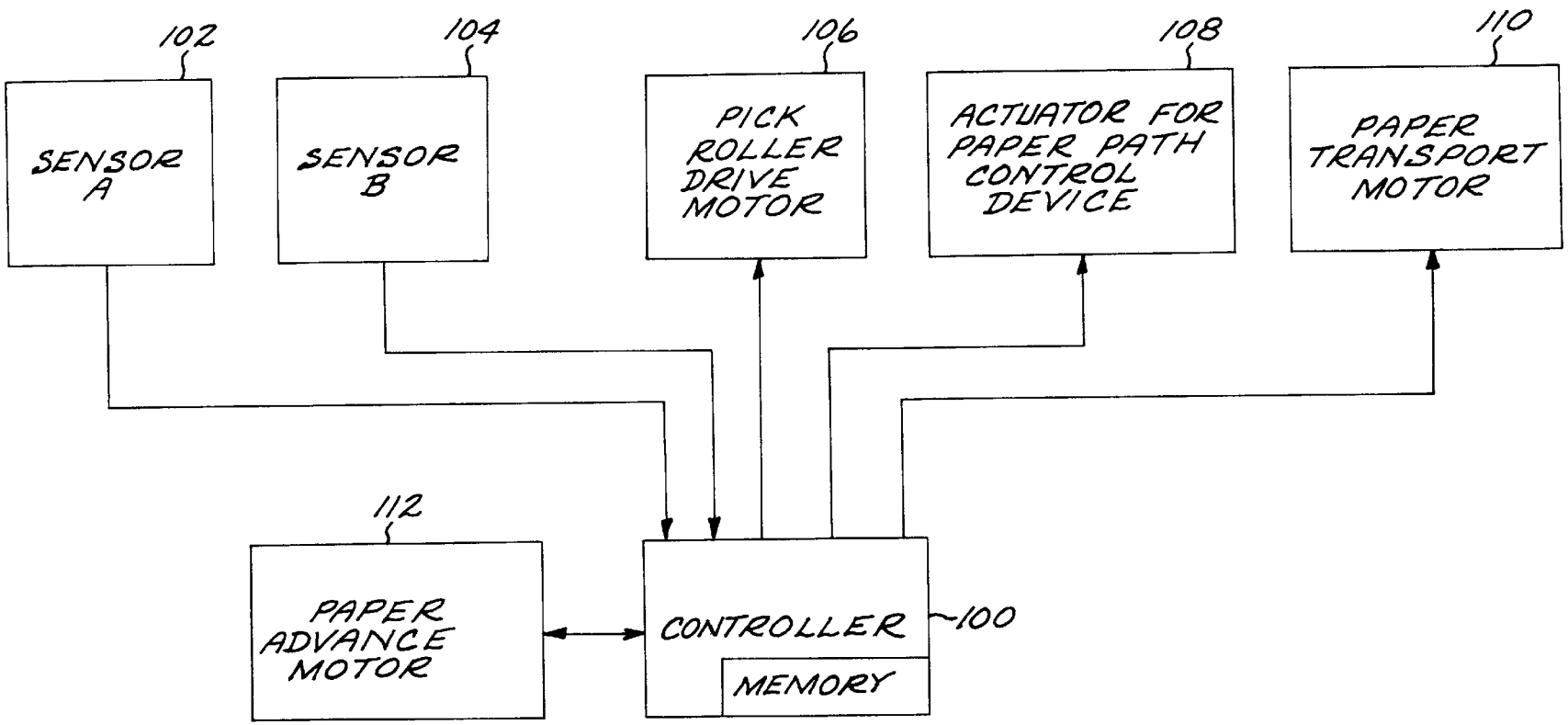
FIG. 8 is a system control block diagram.

FIG. 8 is a schematic block diagram of the control elements comprising the system 50. A controller 100 such as a microprocessor-based device provides overall control of the system, and includes memory for storing code to define the operation of the system. The controller 100 provides control signals to drive the pick roller drive motor 106, which drives the roller 66 and also moves the arm 68, in a dynamic pick system. One rotation direction of the motor 106 facilitates the picking process, and the other rotation direction facilitates the moving of the arm 68. Similarly, the controller sends control signals to the motor 108 for the paper path device 74, the paper transport motor 110 which drives the roller 80, and the paper advance motor 112 which drives the paper advance roller 90. Sensors 102 and 104 send sensor signals to the controller.

Figure 2:
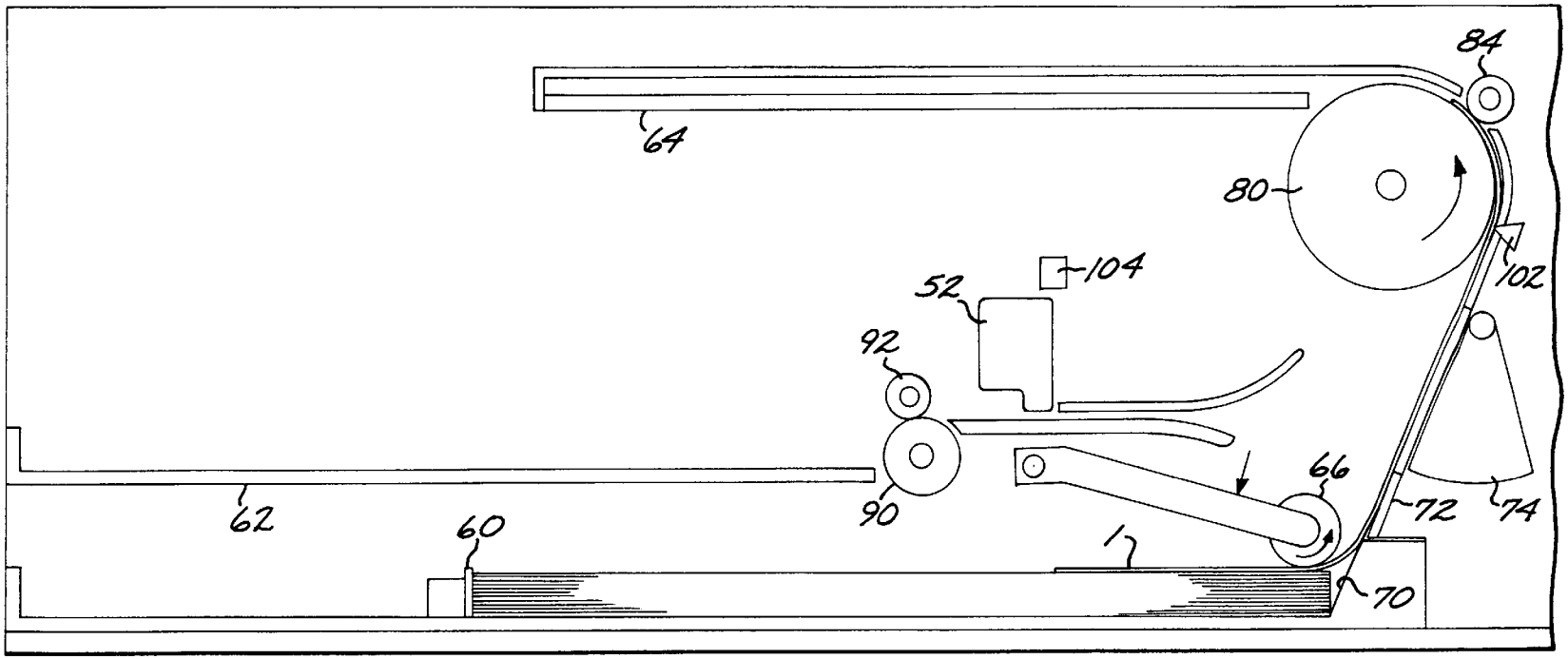
FIGS. 2–6 are similar views, illustrating the paper feed system in different stages of a paper feed operation.
Figure 9A:
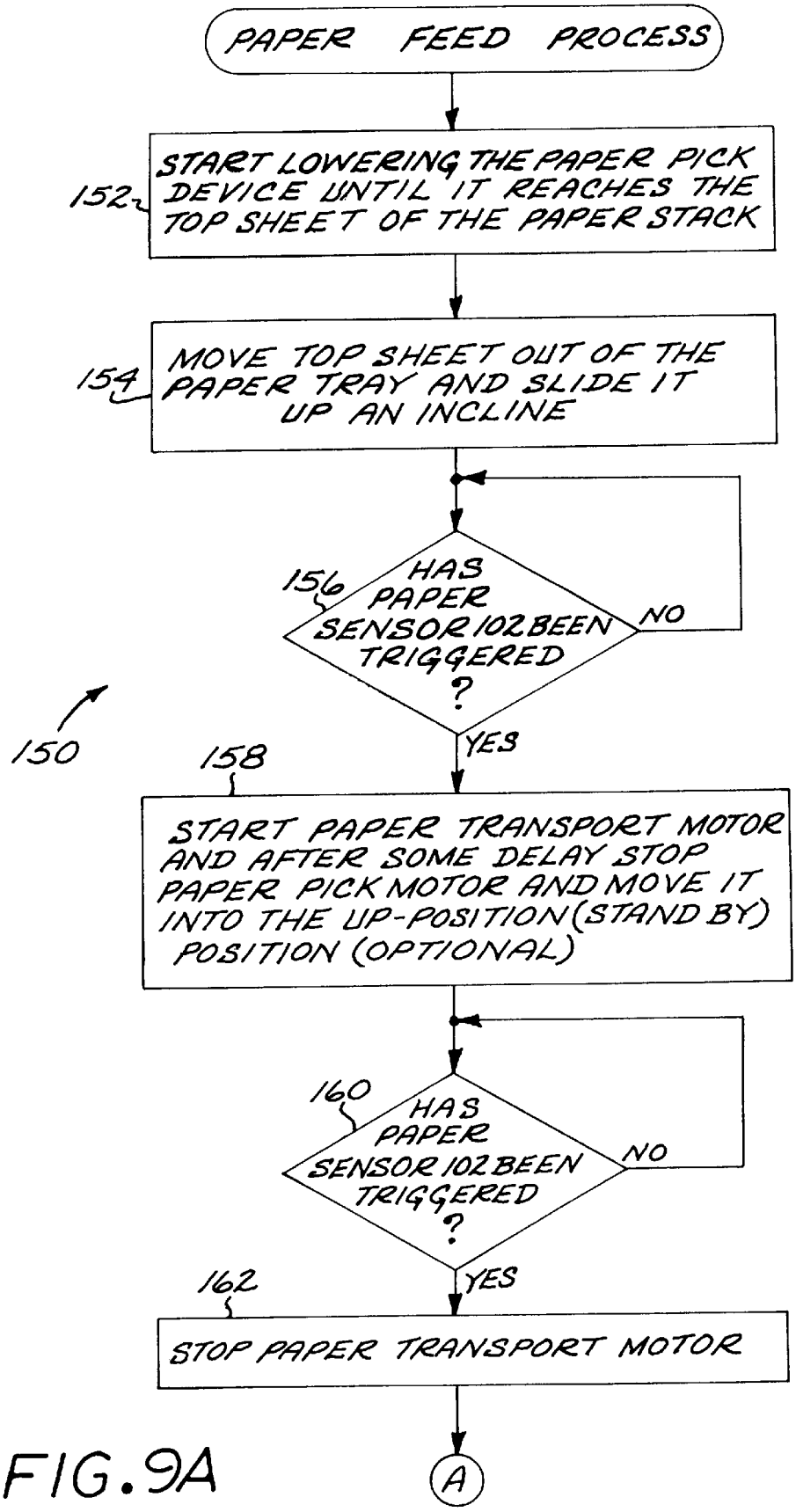
FIGS. 9A and 9B are operational flow diagrams, illustrating the steps in operation of the system.
Figure 9B:
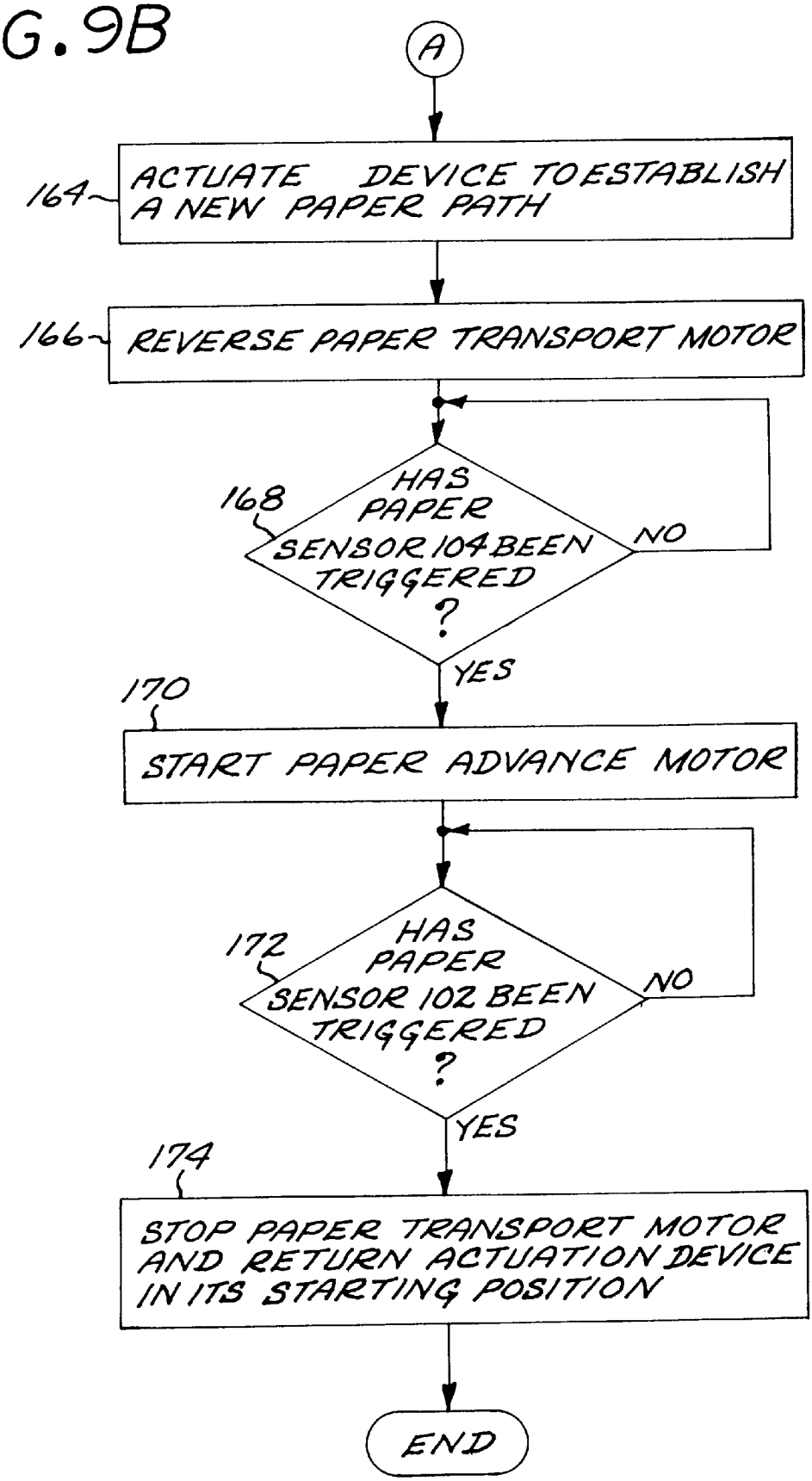

FIGS. 9A–9B illustrate the steps of the sheet feeding process 150 carried out by the exemplary embodiment of FIGS. 1–8. A supply of media sheets are held into the sheet input tray 60. At step 152, the separation or pick roller 66, mounted on arm 68 which pivots about pivot 68A, is activated through commands given to motor 106, and moves out of its stand-by position (shown in FIG. 1) above the first sheet 1 onto the first sheet 1 and lies on top of the sheet 1, as shown in FIG. 2. The separation roller 66 rotates in a counterclockwise direction, and pushes the sheet 1 over the incline surface 70 onto the sheet guide 72 thereby separating the first sheet 1 from the supply of sheets in the tray 60 (step 154). The sheet 1 slides up the sheet guide 72, still being pushed by the separation roller 66. The sheet path control device 74 is in its stand-by position, located below the sliding surface 72A of sheet guide 72.

Figure 4:
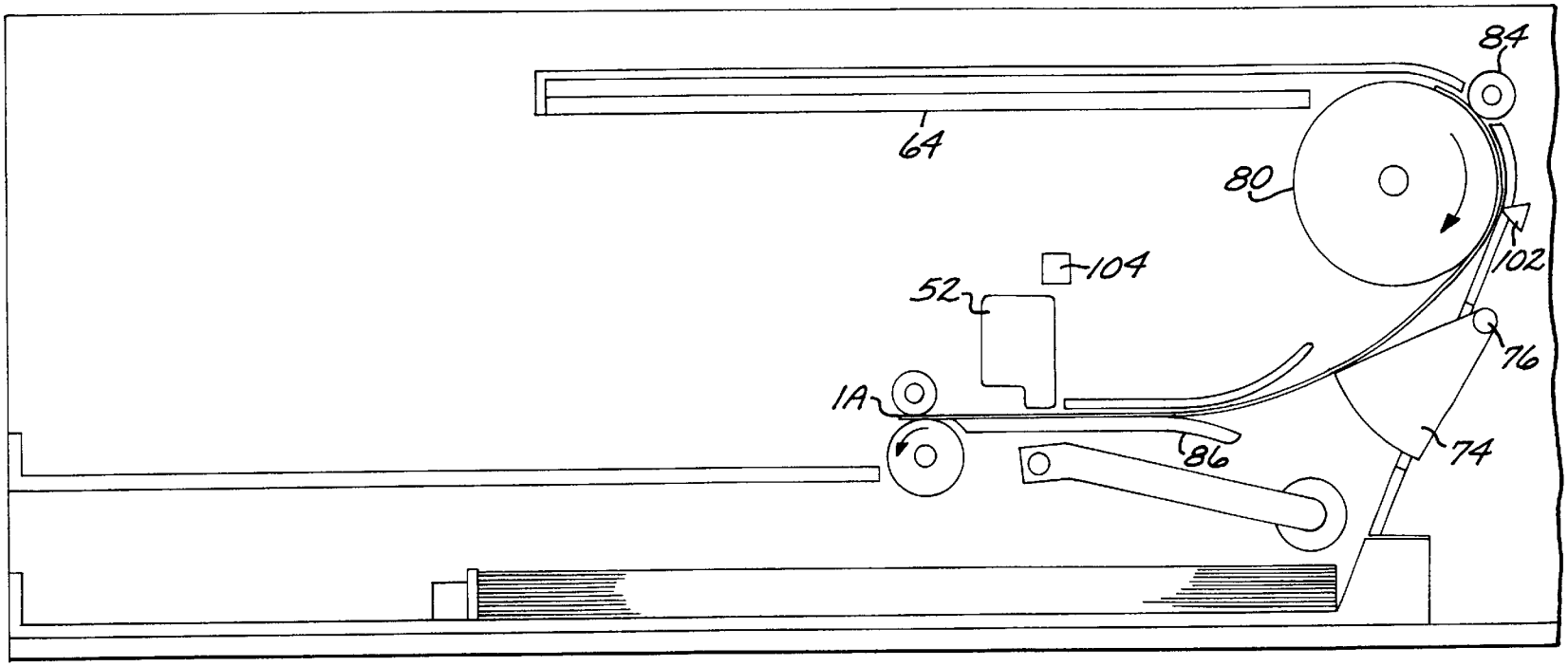
Figure 5:
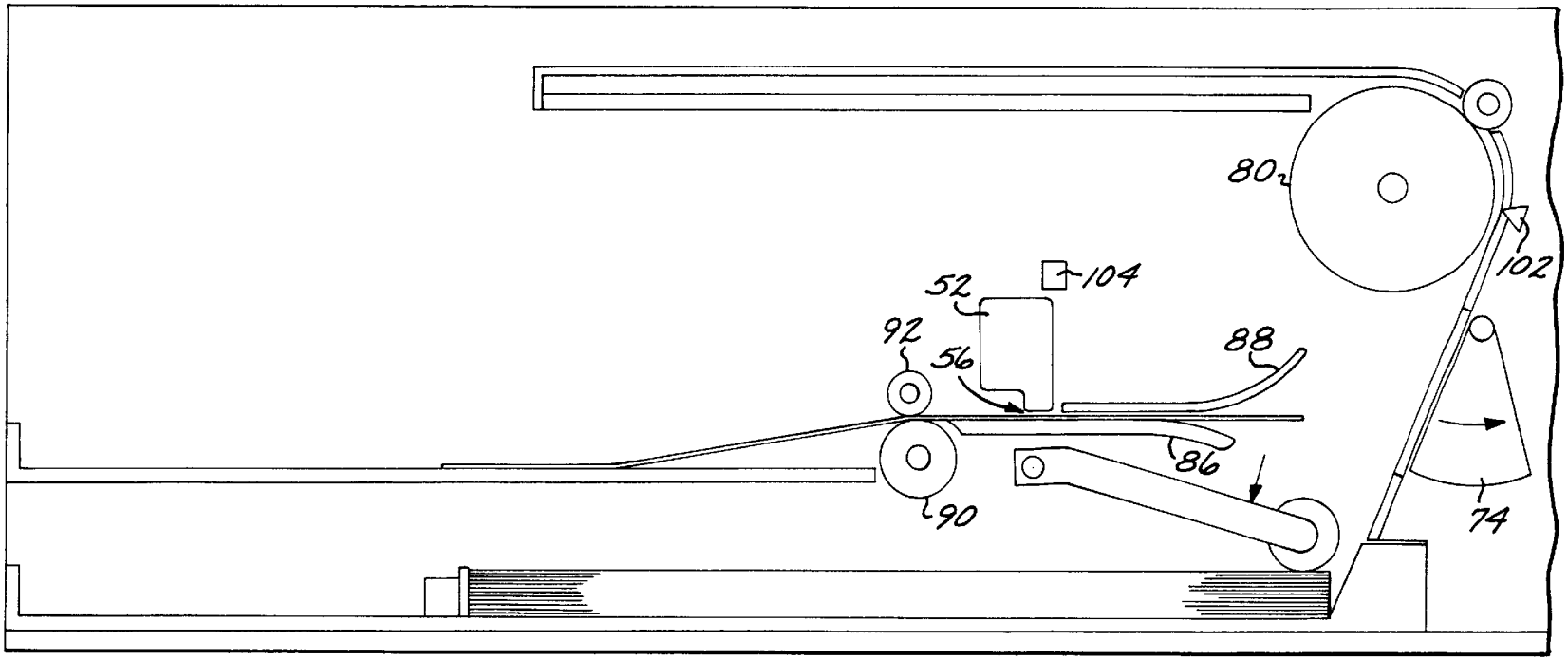

After the sensor 102 is tripped by the leading edge of the sheet 1, as determined at step 156, the paper transport motor 110 is activated to turn the roller 80 in the counterclockwise direction. After some delay sufficient for the leading edge of the sheet 1 to pass into the nip between the rollers 80 and 82, the separation roller 66 stops its rotation, and the sheet 1 is now pulled by the sheet feeding roller 80 out of the sheet tray 60. The separation roller 66 optionally moves in its stand-by position, which is some distance above the first sheet 1. The leading edge of the sheet 1 is forced through a bending radius 82 by the curved path portion 72C of the guide 72. The pinch wheel 82 provides increased traction between the surface of the sheet 1 and the sheet feeding roller 80. The sheet 1 is pushed further through the bending radius 82 by the roller 80 onto the sheet guide 64. The sheet 1 is further pushed onto the sheet guide 64 until the trailing edge of the sheet 1 passes the sensor 102, sending a sensor signal indicating that the trailing edge of the sheet has passed the sensor (step 160). The paper transport motor is then stopped (step 162). The sheet path control device 74 is rotated clockwise about pivot 76 to establish a new paper path directed towards the print table 86 (step 164), in a position (FIG. 3) to move the sheet 1 in a reverse sliding motion onto print table 86. At step 166, the sheet feeding roller 80 is actuated in a reversed rotation direction (FIG. 4). Now, the sheet trailing edge is considered to be the sheet leading edge 1A (FIG. 4). The sheet 1 is pushed in a backward motion, with the new leading edge passing the sensor 102 and causing the sensor to send a signal to the controller 100 (step 168), onto the newly positioned sheet path control device 74 and sliding on this sheet path control device 74 towards the print table 86. At step 170, the paper advance motor 112 is activated, rotating the advance roller 90. The leading edge 1A of the sheet 1 slides off the sheet path control device 74 onto the print table 86. The print table sheet guide 88 forces the sheet 1 to slide flat (no curl) on the print table 86 therefore avoiding sheet (paper) jams. The sheet 1 reaches the sheet advance roller 90, tripping the sensor 104, and is forced slightly downward by pinch wheel 92. The sheet feeding roller 80 advances the sheet 1 past the print zone 56 under the printhead 52A in a manner which minimizes back tension in the sheet. After the sensor 104 is tripped and the leading edge of the sheet is engaged by the rollers 90 and 92, the paper transport motor is stopped, and the sheet path control device is returned to its standby position (step 174).

It will be appreciated by those skilled in the art that a single motor with appropriate coupling systems can be used to operate the pick roller 66, the advance roller 80 and the paper path device 74, instead of multiple motors as described above. Moreover, time delays can be used to synchronize the timing of one or more of the actuations, instead of using sensors such as sensor 104.

Figure 10:
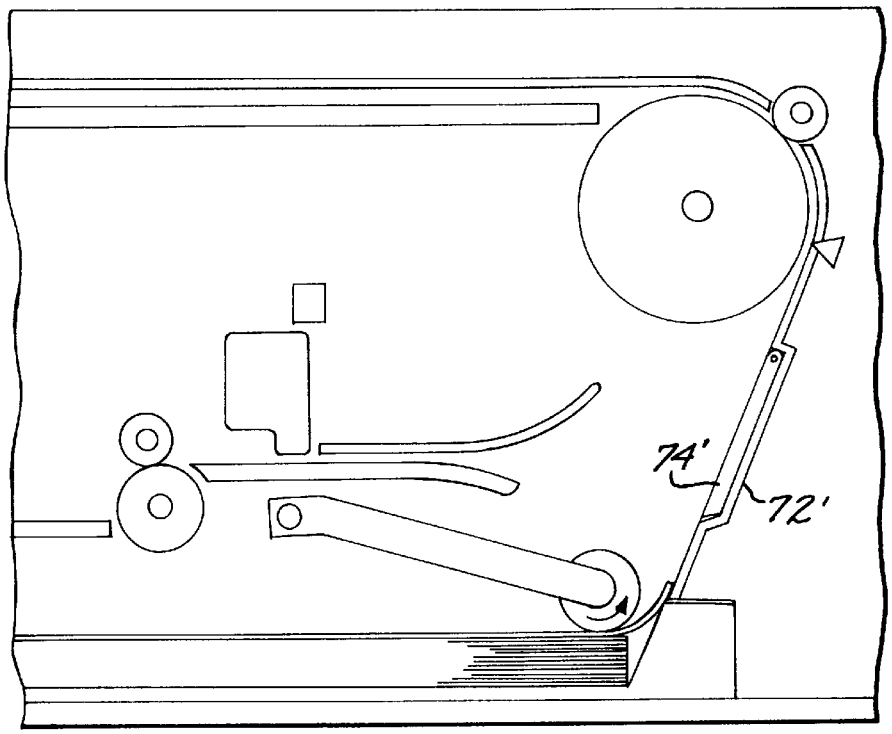
FIGS. 10–11 illustrate an alternate embodiment in respective side views, with a solid vane used as the sheet deflecting element.
Figure 11:
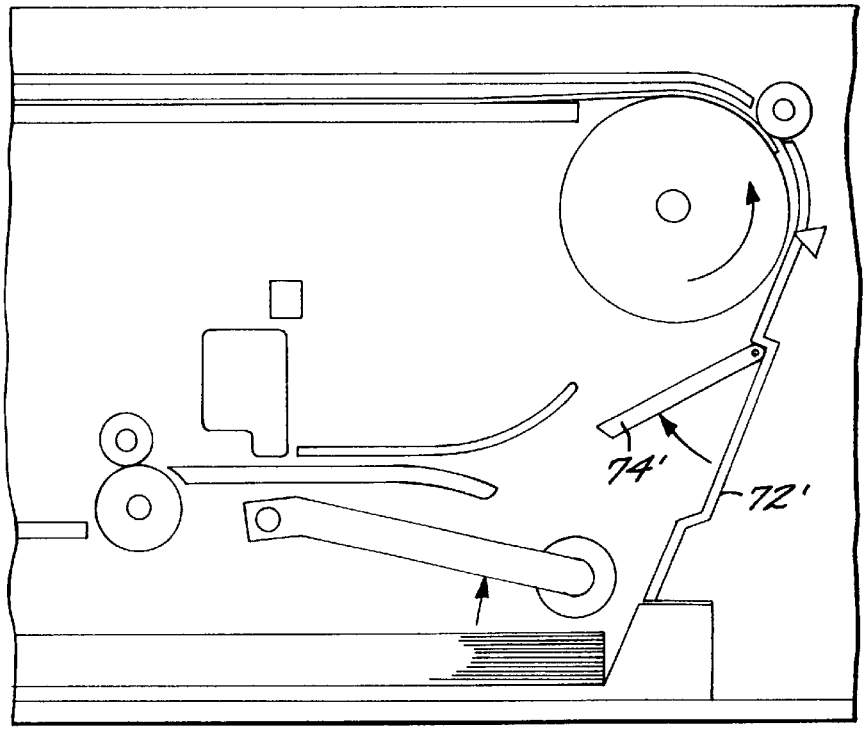

Referring now to FIGS. 10 and 11, an alternative form of the sheet path control device is illustrated. Instead of a device 74 comprising multiple vanes extending through slots in the guide 72 as in the embodiment of FIGS. 1–5, device 74' is a planar flap which fits into a recess in guide 72' in a standby position (FIG. 10) and which moves on a pivot out of the recess (FIG. 11) to change the paper path.

Figure 12:
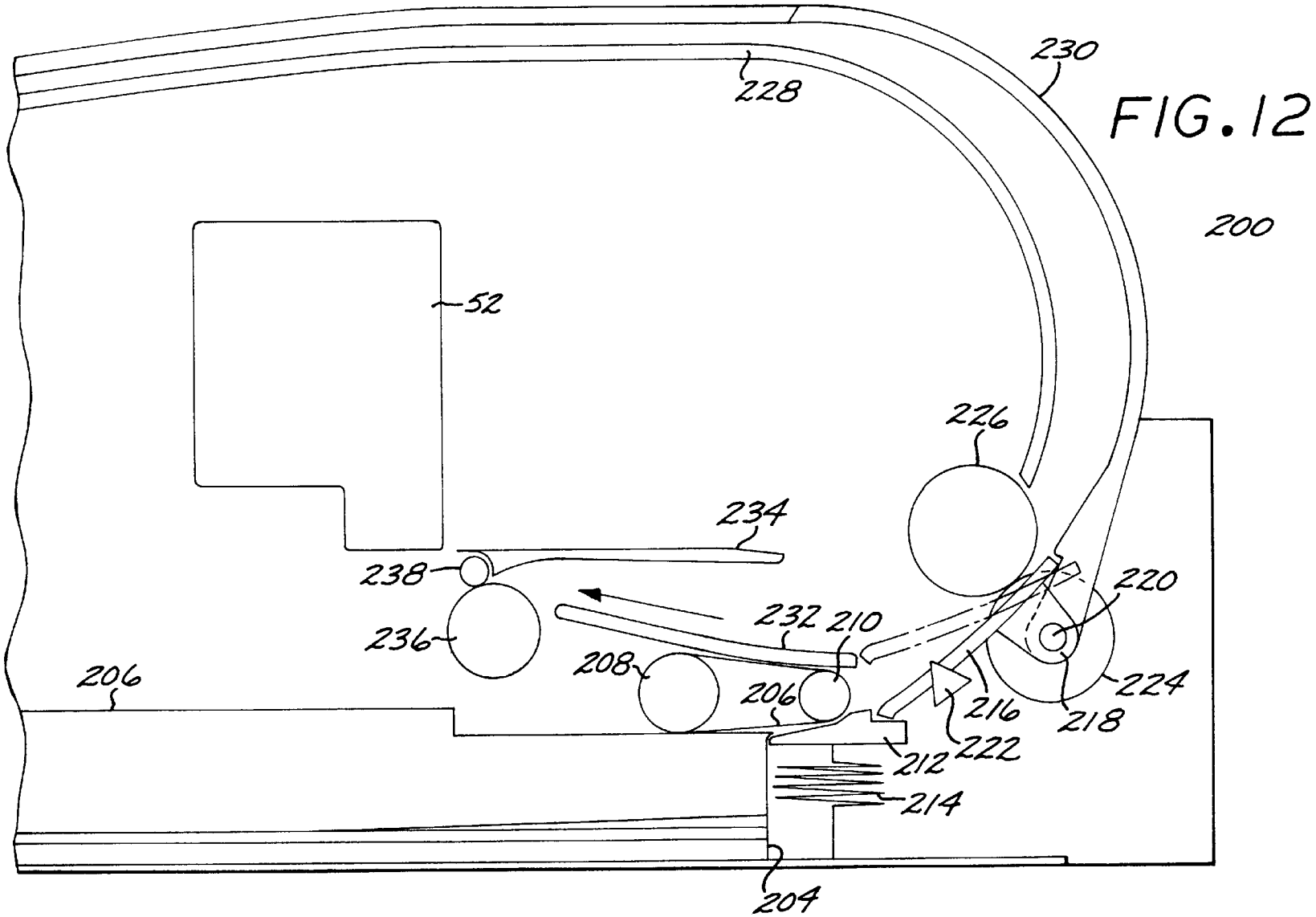
FIG. 12 is a side view of a second alternate embodiment of a compact printing system in accordance with the invention.

FIG. 12 is a side view of an alternate sheet feeding system 200 embodying the invention. This system has a media input tray 204 with a top surface 206 which serves as the media output tray. The sheet pick device includes a belt 206 mounted on belt rollers 208, 210, and a sheet separator 212 biased toward the belt at roller 210 by a spring 214. The sheet path control device in this embodiment is a curved guide member 216 with a bracket end mounted for rotatable movement about pivot 218. The guide member is shown in solid lines in FIG. 12 in its initial position while picking a sheet out of the input tray. A mechanical flag sensor 222 is carried by the guide and is tripped by the passage of the leading edge of a sheet as it is fed by the belt 206 out of the tray 204. A powered auxiliary roller 224 and an idler pinch roller 226 create a nip into which the sheet is fed by the belt drive. The sheet is transported up between curved paper guides 228, 230 until the sensor detects the passage of the trailing edge of the sheet. At this point, the belt 206 and roller 224 are stopped, and sheet path control device is activated to move to the position shown in phantom in FIG. 12, where the edge of the device 216 is aligned with the edge of the guide 232. Now the direction of rotation of roller 224 is reversed, pulling the sheet down the device 216 and onto the guide 232 toward the paper advance roller 236 and idler pinch roller 238. Once the now leading edge of the sheet has been fed into the nip between the rollers 236 and 238, the roller 224 is stopped and the idler pinch roller 226 is moved away from the drive roller 224, removing any tension and drag on the sheet. The roller 236 is rotated to advance the sheet through the print area and output the finished sheet onto the tray 206. In this system, a single motor drive system is used to power the roller 224, roller 236, actuate the sheet path control device 216, and drive the belt system comprising the belt 206 and rollers 208, 210.

This invention provides several advantages. The sheet feeding technique minimizes necessary operating space for paper-handling and minimizing sheet deformation/sheet curl. The technique also minimizes surface degradation of photographic media, since the sheets can be loaded in a user-friendly "print-output-oriented-face-up" orientation, and the sensitive media surface of the sheet (photographic media) is in contact only with the pick-roller and bending roller. The media is forced through the bending-radius by orienting the sensitive surface of the sheet on the inside of the bending radius, in this way minimizing the print-surface damage due to sheet-loading. As the media is fed through the bending-radius, the sensitive surface (on the inside) is in contact only with the rollers. No slipping occurs and therefore no scratching is possible. The "turn-back" motion of the paper is based on a no-slip interface contact between roller and media. Again, surface degradation is minimized. In addition, the sheet path control device works in such a way that it does not touch the sensitive media surface. Further, the technique reduces the risk of paper jams and paper skew.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for feeding a sheet of print media from an input supply device to an ink jet printing device along a media path, comprising:

picking a sheet having opposed first and second sheet surfaces from the input supply device disposed at a supply location adjacent a first side of the printing device and passing the sheet along the media path;

transporting the picked sheet in a forward direction along a curved media path portion and a first linear path portion until a trailing edge of the picked sheet passes a predetermined location on the media path, the picked sheet at a location adjacent a second side of the ink jet printing device, wherein the media path through which the picked sheet is transported during this step is wrapped about the ink jet printing device to conserve space, said first linear path portion disposed in a plane generally parallel to an input plane at which the sheets are supplied by the input supply device, said media path through which the sheet is transported during the transporting step is a generally U-shaped path having said first linear path portion and a second generally linear path portion at the input plane joined by the curved path portion, and the ink jet printing device is positioned between the first and second generally linear portions;

actuating a sheet path control device;

transporting the picked sheet in a reverse direction, such that the trailing edge in a forward direction sense is now the leading edge in a reverse direction sense, and deflecting the picked sheet with the sheet path control device into a printing/output media path portion; and passing the picked sheet along the printing/output media path portion through a printing area adjacent the ink jet printing device to an output end of the printing/output media path portion.

2. The method of claim 1 wherein the step of transporting the picked sheet in a forward direction includes engaging the picked sheet by a paper advance roller which is driven in a first direction to transport the picked sheet in a forward direction, and wherein the step of transporting the picked sheet in a reverse direction includes driving the paper advance roller in a second direction while engaging the picked sheet.

3. The method of claim 1 wherein the step of actuating a sheet path control device includes moving a plurality of vanes through slots in a sheet guide surface such that the vanes provide deflecting surfaces for contacting the picked sheet.

4. The method of claim 1 wherein the step of actuating a sheet path control device includes moving a sheet guide surface element defining a portion of the media path from a first position to a second position.

5. The method of claim 1 further comprising the step of sensing the passage of said trailing edge of said picked sheet when transported in the forward direction, and in response to the sensing, performing the steps of actuating the sheet path control device and transporting the picked sheet in a reverse direction.

6. The method of claim 1 wherein the step of passing the picked sheet along the printing/output media path portion includes engaging the picked sheet by a paper advancing roller in the printing/output media path portion and driving the picked sheet with the paper advancing roller.

7. A sheet feeding system for feeding a sheet of print media from an input supply device to an ink jet printing device along a media path, comprising:

a media path defined through the system and having a curved path portion and a linear path portion connected to the curved path portion, the linear path portion disposed in a plane generally parallel to an input plane at which the sheets are supplied by the input supply device such that the input plane, the curved path portion and the linear path portion define a generally U-shaped path, the media path further including a media printing/output path portion, the media path being wrapped about the ink jet printing device such that the ink jet printing device is disposed between the input supply device and the linear path portion;

a pick apparatus for picking a sheet having opposed first and second sheet surfaces from the input supply device disposed at a supply location adjacent a first side of the printing device and passing the sheet along the media path;

a sheet drive apparatus for transporting the picked sheet in a forward direction along the curved media path portion until a trailing edge of the picked sheet passes a predetermined location on the media path, wherein the picked sheet is at a transport location adjacent a second side of the ink jet printing device;

a sheet path control device positioned in said media path;

the sheet drive apparatus further for transporting tie picked sheet in a reverse direction, such that the trailing edge in a forward direction sense is now the leading edge in a reverse direction sense;

actuating apparatus for moving the sheet path control device for deflecting the picked sheet with the sheet path control device into the printing/output media path portion; and apparatus for passing the picked sheet along the printing/output media path portion through a printing area to an output end of the printing/output media path portion.

8. The system of claim 7 wherein the sheet drive apparatus includes a sheet feeding roller disposed adjacent the curved path portion for engaging the picked sheet, and roller drive apparatus including apparatus for driving the roller in a first direction to transport the picked sheet in a forward direction, and for driving the roller in a reverse direction while engaging the picked sheet.

9. The system of claim 7 wherein the sheet path control device includes a plurality of vanes selectably extendable through slots in a sheet guide surface such that the vanes provide deflecting surfaces for contacting the picked sheet.

10. The system of claim 7 wherein the sheet path control device includes a movable sheet guide surface element defining a portion of the media path, the system further including actuating apparatus for moving the sheet guide surface element from a first position to a second position.

11. The system of claim 7 further comprising a sensor for sensing the passage of the trailing edge of the picked sheet when transported in the forward direction.

12. The system of claim 7 further including a paper advancing roller for engaging the picked sheet in the printing/output media path portion and driving the picked sheet along the printing/output media path portion.

13. The method of claim 1, further characterized in the that first sheet surface of the sheet picked from the input supply device is a media sensitive surface, and in that the media path includes at least one bending radius through which the sheet is passed during said step of transporting the picked sheet in a forward direction, the first surface of the picked sheet remaining on the inside of the bending radius as the sheet is transported.

14. The method of claim 13 wherein each of the at least one bending radius is a large bending radius to minimize sheet curl.

15. The method of claim 1 further characterized in that the first and second linear path portions are generally parallel path portions.

16. The method of claim 15 further characterized in that the first and second linear path portions extend in generally horizontal directions, and wherein the first surface of the sheet is oriented to face upwardly in the input supply device, and faces upwardly at the location adjacent a second side of the ink jet printing device.

17. The system of claim 7, wherein the first sheet surface of the sheet picked from the input supply device is a media sensitive surface, and the media path includes at least one bending radius through which the sheet is passed during said step of transporting the picked sheet in a forward direction, the first surface of the picked sheet remaining on the inside of the bending radius as the sheet is transported.

18. The system of claim 17 wherein the sheet drive apparatus includes a large diameter drive roller structure and an idler roller structure cooperatively arranged to produce a nip, the curved path portion includes a passage along a curved guide and through the nip, the media sensitive surface contacting a drive surface of the large diameter drive roller structure.

19. The system of claim 17 wherein each of the at least one bending radius is a large bending radius to minimize sheet curl.

20. The system of claim 7 wherein the plane of the linear path portion and the input plane extend in generally horizontal directions, and wherein the first surface of the sheet is oriented to face upwardly in the input supply device, and faces upwardly at the location adjacent a second side of the ink jet printing device.

* * * * *

UNITED STATES PATENT AND TRADEMARK OFFICE

CERTIFICATE OF CORRECTION

PATENT NO : 6,042,109

DATED : March 28,2000

INVENTOR(S) : Michael J. Klausbruckner

It is certified that error appears in the above-identified patent and that said Letters Patent is hereby corrected as shown below:

At Column 8, line 44, after "transporting" delete "tie" and insert in lieu thereof --the--.

At Column 9, line 11, after "in", delete "the".

Signed and Sealed this

Twenty-seventh Day of March, 2001

*Attest:*

*Attesting Officer*

NICHOLAS P. GODICI

*Acting Director of the United States Patent and Trademark Office*